United States Patent [19]

Eisenberg

[11] 4,410,199

[45] Oct. 18, 1983

[54] CROSS-COUNTRY SKI BOOT BINDING

[76] Inventor: Joel H. Eisenberg, 53A Blackhawk La., Stratford, Conn. 06497

[21] Appl. No.: 216,968

[22] Filed: Dec. 16, 1980

[51] Int. Cl.[3] ..... A63C 9/00

[52] U.S. Cl. ..... 280/615; 280/625; 280/635; 280/636

[58] Field of Search ..... 280/614, 629, 615, 623, 280/611, 635, 625, 636

[56] References Cited

U.S. PATENT DOCUMENTS

| | | | |
|---|---|---|---|
| 2,072,477 | 3/1937 | Dodd | 280/614 |
| 3,344,538 | 10/1967 | Massicotte | 280/615 X |
| 4,002,354 | 1/1977 | Ramer | 280/614 |
| 4,266,805 | 5/1981 | Weigl | 280/615 |

FOREIGN PATENT DOCUMENTS

| | | | |
|---|---|---|---|
| 168458 | 6/1951 | Austria | 280/614 |
| 207506 | 3/1909 | Fed. Rep. of Germany | 280/618 |
| 2123165 | 11/1972 | Fed. Rep. of Germany . | |
| 2255535 | 5/1974 | Fed. Rep. of Germany . | |
| 2714853 | 10/1978 | Fed. Rep. of Germany | 280/614 |
| 105847 | 1/1965 | Norway | 280/614 |
| 61821 | 2/1924 | Sweden | 280/615 |

OTHER PUBLICATIONS

"The Right Stuff", Seth Masia, pp. 64,65,94, SKI Magazine, Feb. 1981.

"Binding 1981: Mountaineering Designs", Carl Ettlinger, SKIING Magazine, Feb. 1980, pp. 77,78.

*Primary Examiner*—Robert J. Spar

*Assistant Examiner*—Donald W. Underwood

[57] ABSTRACT

A cross-country ski boot binding having a pivot, the pivot disposed so that when a ski boot is in place on the binding, the skier can tilt the boot forward about the pivot thereby providing a rearward driving force or "kick" for an attached ski without any appreciable use of the ankle, foot or leg muscles.

2 Claims, 5 Drawing Figures

CROSS-COUNTRY SKI BOOT BINDING

FIELD OF THE INVENTION

This invention relates to an improvement in cross-country ski boot bindings, particularly in regard to the manner in which the binding cooperates with a ski boot to transmit a driving force or "kick" to an attached cross-country ski.

BACKGROUND OF THE INVENTION

Most prior art cross-country bindings hold the prior art cross-country ski boots by grasping the boot's protruding front lip. The boot is very flexible across the front, and the skier begins skiing by lifting the heel of one boot as if starting to walk. This heel lift requires use of the lower leg muscles. This lifting flexes the boot, and the foot achieves an almost tip-toe position, referred to as a push-off or toe-off position. Then, with the boot and foot so flexed, the skier pushes or "kicks" rearwardly. This kick or push requires extensive use of the skier's gastrocnemius-soleus complex and hip extensors. The rearward kick drives the ski backwardly, and it digs into the snow. The rearward push or "kick" then becomes an opposite forward reaction, which is transferred to the opposite ski causing it to glide forward. The sequence is repeated using alternate boots for kicking and gliding, and the skier moves along.

Because of the flexible nature of the prior art cross-country boots, which nature is dictated by function as explained, the prior art boots have several substantial drawbacks. First, the skier's foot and leg work against gravity, and as a result, the skier must exert a great deal of energy in order to flex the boot and kick. In the course of a cross-country ski trip, this results in an exorbitant kilocalorie expenditure. Furthermore, this effort places a great deal of force or strain on a small area of the tendon in the rear of the leg, and this can cause tendon damage. Also, the associated foot, ankle and leg muscles are used and strained, and this often causes soreness, fatigue and sometimes even muscle damage.

Also, since the prior art cross-country boot must be flexible, it is generally made of soft leather or a plastic material, neither of which provides much warmth for the skier's foot and neither of which is waterproof.

Another major drawback of the prior art cross-country ski boot becomes evident when the skier attempts to turn or ski downhill. Turning is accomplished by transmitting pressure through the ski boot or against the sides of the boot to the edges of the skis. While this is easily done with the rigid downhill ski boots, it is difficult to do with the prior art cross-country ski boot, the soft sides of which tend to collapse or compress rather than transmit any force from the foot to the skis. Therefore, the skier does not have very good ski control when sliding downhill. Further, since the soft side of the prior art boots provide no lateral support, they make it necessary for the skier to use the inverters and everters of the ankles a stabilizers for the foot, thereby increasing muscle strain.

SUMMARY OF THE INVENTION

I have discovered that the kicking action required for cross-country skiing can be easily made by a binding which allows the skier's foot to pivot so that by merely tilting the foot forward, a backward push or kick is transmitted to the attached ski. Further, an inflexible ski boot can be used with this binding.

In a preferred embodiment, a binding of this invention includes pivot means in the form of raised sidewalls, each of which receive an axle extending from the sides of the front portion of a ski boot. When mounted in the binding, the boot can then tilt forward and back about the axle.

In another embodiment a wedge mounted on an extension of the binding is used as a fulcrum for the boot, and in other embodiments the portion of the binding holding the boot is tiltable.

This invention permits a standard downhill ski boot with only minor modifications to be attached to the binding of this invention so that the boot can function as a cross-country boot. It is also possible to use existing cross-country boots with the binding of this invention to achieve the same effect, but the flexible nature of the boot will diminish the amount of ski control that is possible with the more rigid downhill ski boot.

PREFERRED EMBODIMENTS

I turn now to a description of the structure and operation of the preferred embodiments of the invention after first briefly describing the drawings.

STRUCTURE

Figure 1:
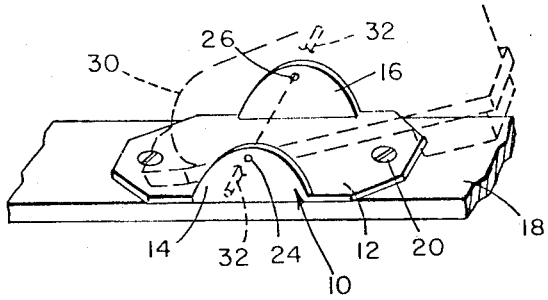
FIG. 1 is a prespective view of the preferred embodiment of the invention.

Referring to FIG. 1, a cross-country binding of this invention is shown at 10. The binding 10 comprises a base plate 12 and two sidewalls 14, 16. Base plate 12 is attached to the top surface of a ski 18 by screws 20. Sidewalls 14, 16 extend upwardly from opposite sides of base plate 12. Each sidewall 14, 16 has a hole 24, 26 therethrough, which holes are horizontally aligned. The binding 10 is preferably made of metal, but other materials may be used.

OPERATION

A ski boot 30 (shown in place in a tilted position in the binding) for binding 10 has an axle 32 which extends from the sides of a forward portion of the boot. The axle 32 of the boot 30 fits into holes 24, 26 in the sidewalls 14, 16 of the binding 10. The binding and axle arrangement provides a pivot for the front of the boot, so that the skier can tilt the boot thereby providing a rearward kick for the attached ski 18. The binding 10 provides all the support for the front of the boot, but it is possible to have some portion of the front of the boot also contacting the top of the ski when the boot is tilted. Also, it is possible to add a slot (not shown) in each sidewall, which slots communicate with the holes 24, 26. The boot axle could then be put into the holes 24, 26 by sliding it through the slots, and the slots then sealed once the axle is in place.

OTHER EMBODIMENTS

Figure 2:
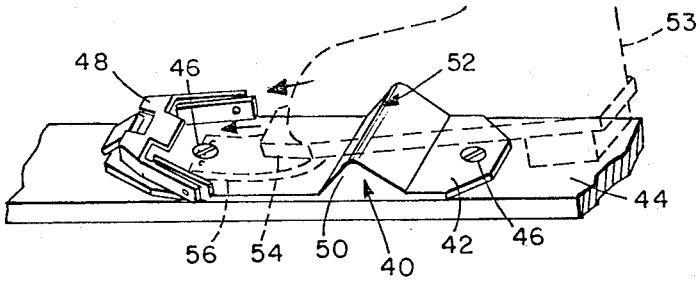
FIG. 2 is a perspective view of another embodiment of the invention.

As shown in FIG. 2, a binding 40 comprises a base plate 42 which is attached to the top surface of a ski 44 by screws 46. A releasable toe grip 48 for a conventional cross-country binding is mounted at the front end of plate 42, and a wedge-shaped fulcrum 50 having an apex 52 is disposed near the other end of the plate 42. In operation, the front portion of a sole 54 a ski boot 53 (shown being inserted) rests on the apex 52 of fulcrum 50. A tongue or lip 56 from the front of the boot fits into and is held by the conventional toe grip 48. The boot can then tilt forward about the fulcrum 50 thereby providing a rearward kick for the ski 44.

Figure 3:
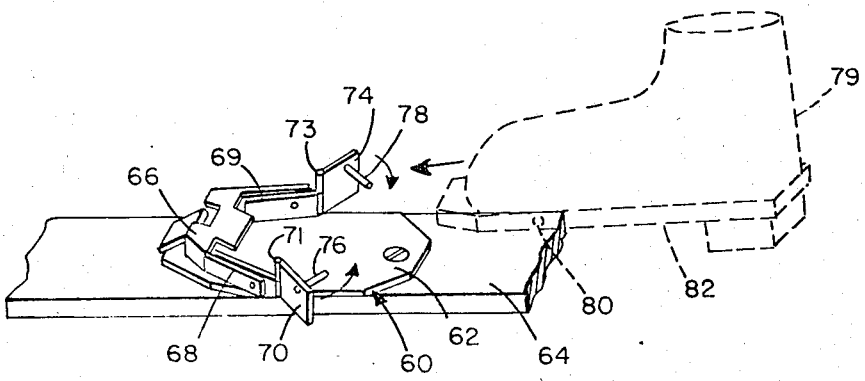
FIG. 3 is a perspective view of another embodiment of the invention.

In another embodiment shown in FIG. 3, a binding 60 has a base plate 62 attached to a ski 64, as in the previous embodiments. The grip 66 for a conventional cross-country binding is connected to the forward end of the plate 62. The grip 66 has a pair of sidewalls 68, 69 which extend rearwardly. The end of sidewall 68 opposite the grip 66 is connected to a wall section 70 by hinge 71. Similarly, the other sidewall 69 is connected by hinge 73 to another wall section 74. Both hinged wall sections 70, 74 have inwardly-extending pegs 76, 78, and the sections 70, 74 can pivot about the hinges 71, 73. In operation, a ski boot 79 having peg holes 80 (only one shown) on opposite sides of the front portion of its sole 82 is inserted between the sidewalls 68, 69. The wall sections 70, 74 are then swung toward the boot 79 so that the pegs 76, 78 engage the peg holes 80 in the sides of the boot sole 82. The front portion of the boot 79 is then suspended above the top surface of the ski 64, as in the embodiment of FIG. 1, and the boot can pivot forward and back about the pegs 76, 78. The weight of the skier's foot keeps a downward force on the pegs, which force prevents the pegs from pulling out of the holes 80. As an additional means of attachment, the front lip of the ski boot can be made long and flexible, as shown in FIG. 2, to be received by the grip 66.

Figure 4:
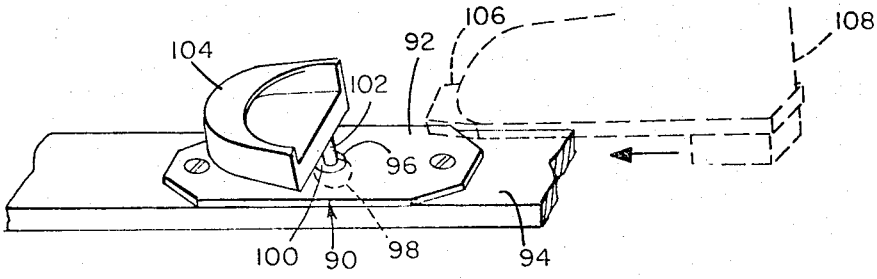
FIG. 4 is a perspective view of another embodiment of the invention.

Another embodiment is shown in FIG. 4. There, a binding 90 comprises a base plate 92 which is attached to a ski 94. The plate 92 has a central hole 96. A portion of the ski 94 beneath the hole 96 is hollowed out to form a socket 98. Ball 100 fits in socket 98 so that a shaft 102 from the ball 100 extends upwardly through plate hole 96. Shaft 102 supports a toe grip 104. In operation, a lip 106 of a boot 108 is inserted into toe grip 104 which holds the lip 106 in the same manner as a conventional toe grip. The ball 100 and socket 98 permits the boot 108 to be tilted forward to "kick". For side-to-side stability, it may be desirable to add a second ball and socket or to limit the movement of the shaft 102 by making the hole 96 a rectangular slot. If the plate is of sufficient thickness, the socket may also be made as part of the plate.

Figure 5:
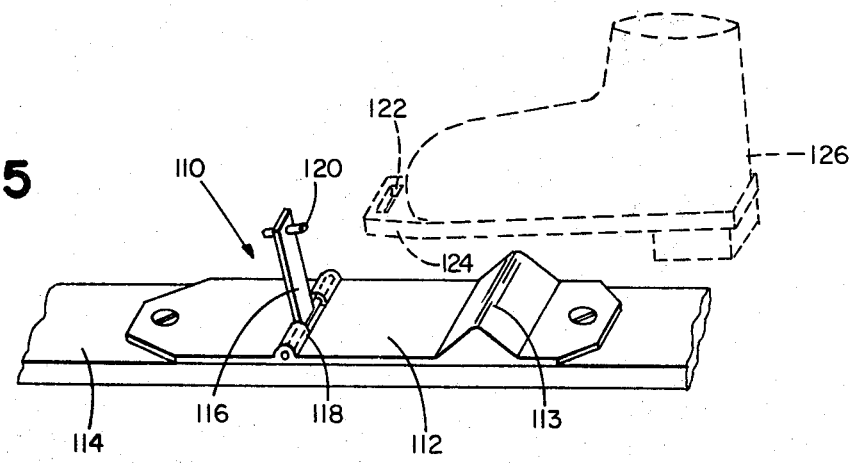
FIG. 5 is a perspective view of another embodiment of the invention.

In another embodiment as shown in FIG. 5, a binding 110 has a plate 112 which can be attached to a ski 114. The plate 112 has a wedge-shaped fulcrum 113 like that of FIG. 2. One end of a tongue 116 is connected to the plate 112 by a hinge 118 so that the tongue 116 can pivot about the hinge 118. The end of the tongue 116 opposite the hinge 118 has a removable peg 120. A rectangular slot 122 extends through a front lip 124 of a ski boot 126 to be mounted. The peg 120 is removed from the tongue 116, and the tongue 116 is slipped through the slot 122. The peg 120 is then replaced. The boot can then tilt about the fulcrum 113, and the boot is held on the ski by the tongue 116 and peg 120.

Other variations will occur to those skilled in the art.

What is claimed is:

1. A ski boot binding comprising:

means for attaching said binding to a ski, means for receiving a ski boot, and pivot means, said pivot means disposed with respect to the ski boot so as to be rearward of the toe area of the boot when the boot is in place to balance the boot so that little effort is required to lift the heel of the boot and disposed with respect to said means for attaching and said means for receiving so that the ski boot can tilt forward about said pivot means thereby providing a rearward kick wherein said pivot means comprises at least one peg adapted to be received by the ski boot and wherein said means for receiving comprises a toe grip disposed at one end of a plate, said grip having a pair of sidewalls extending rearwardly therefrom, said sidewalls each being connected by a hinge to a wall, each said wall supporting one said peg.

2. A ski boot binding comprising:

means for attaching said binding to ski, means for receiving a ski boot, and pivot means, said pivot means disposed with respect to the ski boot so as to be rearward of the toe area of the boot when the boot is in place to balance the boot so that little effort is required to lift the heel of the boot and disposed with respect to said means for attaching and said means for receiving so that the ski boot can tilt forward about said pivot means thereby providing a rearward kick wherein said means for receiving comprises a tongue, said tongue being pivotally connected to said means for attaching, and said tongue being adapted to be received by a portion of the ski boot, said means for attaching comprises a plate, said tongue being pivotally connected to said plate by a hinge, wherein the ski boot has a slot in its front lip and said tongue is disposed to fit through the slot when the boot is in place, and wherein a peg is attached to the end of said tongue opposite said hinge when the boot is in place to prevent the boot from slipping off of said tongue.

* * * * *